United States Patent [19]

van den Broek

[11] Patent Number: 4,748,370

[45] Date of Patent: May 31, 1988

[54] COLOR DISPLAY TUBE HAVING TENSIONED COLOR SELECTION ELECTRODE AND MOUNTING ARRANGEMENT

[75] Inventor: Adrianus van den Broek, Eindhoven, Netherlands

[73] Assignee: U.S. Philips Corporation, New York, N.Y.

[21] Appl. No.: 936,062

[22] Filed: Nov. 28, 1986

[30] Foreign Application Priority Data

Dec. 2, 1985 [NL] Netherlands ..... 8503328

[51] Int. Cl.[4] ..... H01J 29/07; H01J 29/82

[52] U.S. Cl. ..... 313/404; 313/407

[58] Field of Search ..... 313/402, 404, 407

[56] References Cited

FOREIGN PATENT DOCUMENTS 121023 10/1984 European Pat. Off. ..... 313/402

*Primary Examiner*—David K. Moore
*Assistant Examiner*—K. Wieder
*Attorney, Agent, or Firm*—John C. Fox

[57] ABSTRACT

A flat color selection electrode is tensioned on a supporting frame. In order to compensate for differences in thermal expansion between the supporting frame and the color selection electrode and mislanding, spring constructions connect the supporting frame and the color selection electrode and permit only a maximum tension at the color selection electrode which is smaller than the elastic proof stress of the color selection electrode. Such a color selection electrode may be used in a color display tube having an at least substantially flat display screen.

10 Claims, 2 Drawing Sheets

COLOR DISPLAY TUBE HAVING TENSIONED COLOR SELECTION ELECTRODE AND MOUNTING ARRANGEMENT

BACKGROUND OF THE INVENTION

The invention relates to a color display tube comprising in an evacuated envelope means to generate a number of electron beams and comprising an at least substantially flat display screen having areas luminescing in different colors and a color selection electrode having apertures for passing the electron beams and associating each electron beam with luminescent areas of one color, said color selection electrode being tensioned on a supporting frame of at least one set of oppositely located sides.

The invention also relates to a color selection electrode tensioned on a supporting frame for use in a colour display tube according to the invention.

Nowadays, nearly all commercial color display tubes have domed display screens. However, it is desired to provide a tube having a generally flat display screen. There are problems which have to be solved before a tube having a flat display screen is commercially available. A major problem concerns the color selection electrode. In known constructions of a tube having a domed display screen the color selection electrode is similarly curved and in such a manner that the color selection electrode varies slightly parallel to the contor of the display screen. Starting from such a known construction the color selection electrode of a tube having a substantially flat display screen should have a flat contor. However, such a color selection electrode has an insufficient non-deformability or rigidity. One manner of giving a color selection electrode rigidity is disclosed in U.S. Pat. No. 4,069,567. In this specification a method is disclosed of installing a color selection electrode in a color display tube in which the color selection electrode is kept tensioned in a supporting frame. The supporting frame may be of metal and may be placed in the evacuated envelope of The tube at a certain distance from the display screen. Alternatively the supporting frame may be substantially of glass, so that, for example, the frame may be constituted by the display screen or the evacuated envelope of the tube. In a preferred embodiment of this method of installing a color selection electrode, the color selection electrode is manufactured from a material which has a coefficient of thermal expansion exceeding that of the supporting frame. The color selection electrode and the supporting frame are heated together, for example in an oven, while the color selection electrode is tensioned. Simultaneously the color selection electrode is heated complementarily. The supporting frame and the color selection electrode consequently expand. However, as a result of the complementary heating the color selection electrode expands more than the supporting frame. The color selection electrode is then fixed to the supporting frame. The color selection electrode and the supporting frame are finally cooled to room temperature as a result of which the color selection electrode is extra tensioned.

During the processing and the operation of the display tube, however, temperature differences occur between the color selection electrode and the supporting frame which can increase or decrease the tension of the color selection electrode. During the cooling portion of a number of process steps, for example bonding components of the envelope together and evacuating the display tube, the supporting frame will be warmer than the color selection electrode as a result of the difference in thermal capacity. This causes such a great difference in expansion between the supporting frame and the tensioned color selection electrode that the tension in the color selection electrode in this stage can become larger than the elastic proof stress (i.e. the elastic limit) of the color selection electrode, as a result of which it may be deformed permanently. After cooling the adhered or evacuated display tube the deformed color selection electrode is slack in the supporting frame. As a consequence mislanding occurs, i.e. each electron beam is not properly associated with luminescent areas of one color.

It is an object of the invention to provide a color display tube having a color selection electrode which is secured to a supporting frame with a tension which is as large as possible, in which differences in thermal expansion between the color selection electrode and the supporting frame can be permitted without the tension in the color selection electrode becoming larger than the elastic proof stress of the color selection electrode.

SUMMARY OF THE INVENTION

According to the invention, a color display tube of the kind mentioned in the opening paragraph is characterized in that at least one side of each set of oppositely located sides of the color selection electrode connected to the supporting frame is connected to said supporting frame by means of a spring construction, the spring construction only permitting a mximum tension on the color selection electrode which is smaller than the elastic proof stress of the color selection electrode. The spring construction serves as a buffer to reduce changes in tension. Changes in tension which occur are not transmitted directly the between color selection electrode and the supporting frame but via the spring construction. By making the spring construction so that the maximum tension of the color selection electrode remains smaller than the elastic proof stress of the color selection electrode, the tension with which the color selection electrode is connected to the supporting frame may approach said elastic proof stress as close as possible. The spring construction then prevents a permanent deformation of the color selection electrode. Moreover as a result of this a maximum-tensioned color selection electrode is obtained.

An embodiment of a color display tube in accordance with the invention is characterized in that each spring construction has a spring constant which is smaller than the spring constant of the color selection electrode. The color selection electrode may be considered as a spring which has a certain spring constant which depends inter alia on the intrinsic spring constant of the color selection electrode material and on the pretreatment to which the color selection electrode has been subjected, for example the etching of apertures therein. By exerting tensile stresses on the color selection electrode it is elongated elastically. When said tensile stresses reach the elastic proof stress of the color selection electrode, the color selection electrode is deformed permanently. When the tensile stresses between the supporting frame and the color selection electrode are transmitted via a spring construction whose spring constant is smaller than the spring constant of the color selection electrode, said spring construction is elongated more than the color selection electrode. The effective tensile stress which the color selection electrode experiences hence becomes smaller so that the point at which the color selection electrode would otherwise reach its elastic proof stess is changed.

A further embodiment of a color display tube in accordance with the invention is characterized in that both sides of each set of oppositely located sides of the color selection electrode which are connected to the supporting frame are connected to said supporting frame by means of a spring construction. If only one side of each set of oppositely located sides which are connected to the supporting frame is connected to the frame by means of a spring construction, a possible mislanding may occur in the case of a change in size of the color selection electrode, which mislanding is non-symmetrical with respect to the centre of the color selection electrode since the color selection electrode is held by the spring construction only on one side. By providing a spring construction on both sides of each set of oppositely located sides of the color selection electrode, which construction is connected to the supporting frame, the possibly occuring mislanding becomes symmetrical.

It is a further object of the invention to provide a color display tube having a tensioned color selection electrode in which no mislanding occurs.

Thus, a further embodiment of the color display tube in accordance with the invention is characterized in that the spring constructions only permit movements of the apertures in the color selection electrode along the electron paths. When the possibly occurring mislanding becomes symmetrical, this can be removed successfully by converting all the movements of the apertures in the color selection electrode, for example, resulting from thermal loads, vibrations, impact or stroke, via the spring constructions into movements exclusively along the electron paths.

The spring construction may be built up from a number of leaf springs extending over the length of a side of the color selection electrode or from one long leaf spring which is provided over the length of a side.

A still further embodiment of a color display tube having a color selection electrode in accordance with the invention is characterized in that each leaf spring referred to above comprises a substantially flat surface to which a major surface of the color selection electrode is connected. Since a major surface, the upper surface or the lower surface, of the color selection electrode is connected to a flat surface of each leaf spring of which the spring construction is composed, the color selection electrode remains flat also during movements. Hence bending stresses which may change the shape of the color selection electrode in an undesirable manner do not occur.

A still further embodiment of a color display tube having a color selection electrode in accordance with the invention is characterized in that each leaf spring comprises a Z-shape. Said Z-shape of a leaf spring is easy to produce. By means of a Z-shaped leaf spring it is easy both to convert the movements of the color selection electrode into movements along the electron paths and to connect the color selection electrode to each leaf spring.

A yet further embodiment of a color display tube having a color selection electrode in accordance with the invention is characterized in that each spring construction has a coefficient of thermal expansion which is substantially equal to the coefficient of thermal expansion of the color selection electrode. The spring constructions are connected to the color selection electrode by means of welding or otherwise. During the processing and operation of the display tube temperature variations occur. When the thermal expansion of the spring construction differs from the thermal expansion of the color selection electrode, deformations along the welding seam may occur both in the color selection electrode and in the spring construions. One way to reduce said deformations to an acceptable level is to match the coefficient of thermal expansion of each spring construction to that of the color selection electrode.

BRIEF DESCRIPTION OF THE DRAWINGS

An embodiment of the invention will now be described in greater detail with reference to the accompanying drawings in which.

DESCRIPTION OF THE PREFERRED EMBODIMENTS

Figure 1:
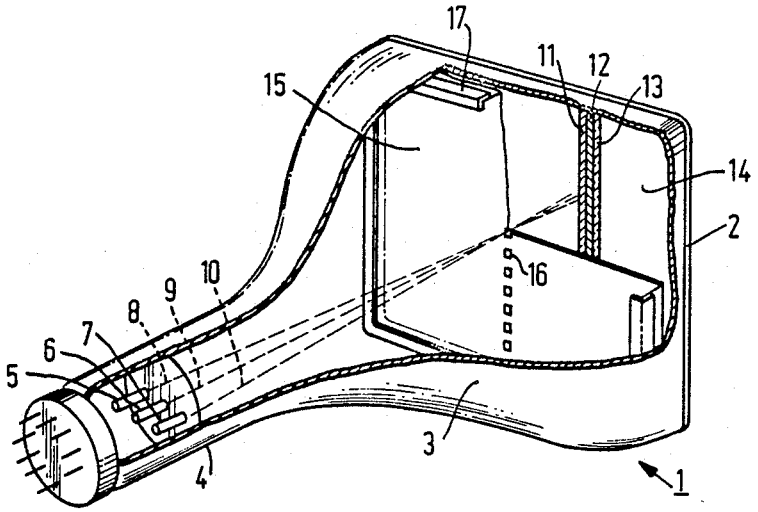
FIG. 1 is a diagrammatic perspective view of a color display tube having a substantially flat display screen.
Figure 2:
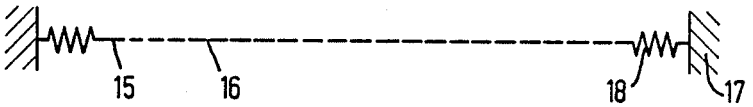
FIG. 2 shows diagrammatically a color selection electrode which is connected to a supporting frame via a spring construction.
Figure 3:
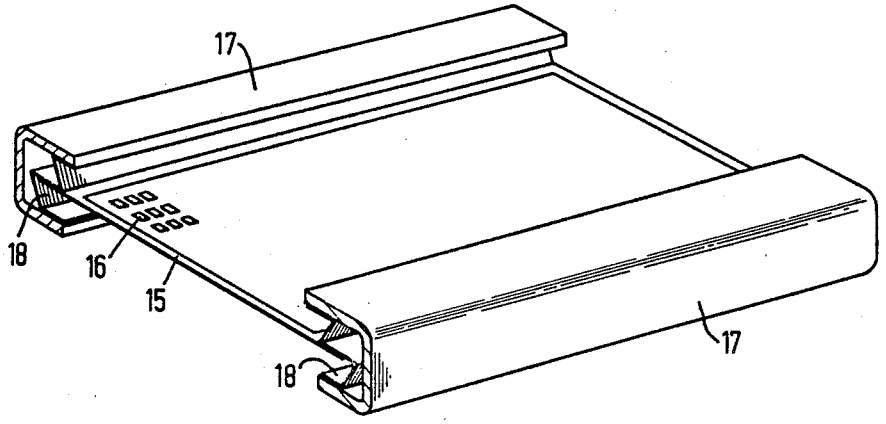
FIG. 3 is a perspective view of a color selection electrode according to the invention connected to a supporting frame.

The color display tube shown diagrammatically in FIG. 1 comprises in a glass envelope 1 three electron guns 5, 6 and 7 for generating three electron beams 8, 9 and 10 which envelope is composed of a substantially flat display window 2, a cone 3 and a neck 4. The display window 2 comprises on its inside a great number of triplets of phosphor lines. Each triplet comprises a line 11 consisting of a blue-luminescing phosphor, a line 12 consisting of a green-luminescing phosphor, and a line 13 consisting of a red-luminescing phosphor. All triplets together constitute the display screen 14. Positioned in front of the display screen 14 is a color selection electrode 15 in which a very great number of apertures 16 is provided through which the electron beams 8, 9 and 10 pass to impinge only on phosphor lines of one color. The color selection electrode 15, which is flat, is tensioned on a supporting frame 17. Said tension is necessary to give the flat color selection electrode 15 sufficient non-deformability and rigidity. During operation of the color display tube a great part of the electron current on its way to the display screen 14 impinges on the color selection electrode 15 so that heating of the color selection electrode 15 occurs. As a result of this the color selection electrode 15 expands so that a reduction of the tension of the color selection electrode 15 and consequently mislanding may occur. On the other hand, the tension on the color selection electrode 15 may be increased during the cooling phases of a number of manufacturing process steps of the color display tube, and by vibrations, impacts and the like. When the stess reaches a value above the elastic proof stess of the color selection electrode 15 the latter is deformed permanently. In order to prevent said permanent deformation, according to the invention a spring construction 18 is placed between the tensioned color selection electrode 15 and the supporting frame 17 as is shown diagrammatically in FIG. 2. This spring construction 18 allows differences in expansion and movements between the supporting frame 17 and the color selection electrode 15. The spring construction 18 has a spring constant which is smaller than the spring constant of the color selection electrode 15. The spring constant of the color selection electrode 15 depends on the material from which the color selection electrode 15 is manufactured but also, for example, on the pattern of the apertures 16 in the color selection electrode 15. So in the case of a given color selection electrode 15 the spring construction 18 should be constructed that, by a choice of the material and the shape, the spring constant of the spring construction 18 smaller than the spring constant of the color selection electrode 15. As a result of this the spring construction 18 has a longer travel than the color selection electrode 15 so that the increase of the tension caused by the difference in expansion between the supporting frame 17 and the color selection electrode 15 remains acceptable. By providing spring constructions 18 on both sides of oppositely located sides of the color selection electrode 15 and by forming the spring constructions 18 in such a manner that the movements performed by the color selection electrode 15 and consequently also by the apertures 16 in the color selection electrode 15 take place only along the electron paths, for example the electron path 8 as is shown in FIG. 4, mislanding is also prevented.

Figure 4A:
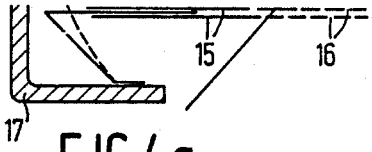
FIGS. 4*a* and 4*b* are sectional views of two forms of spring constructions according to the invention which are connected to a supporting frame.
Figure 4B:
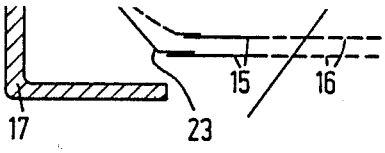
Figure 5A:
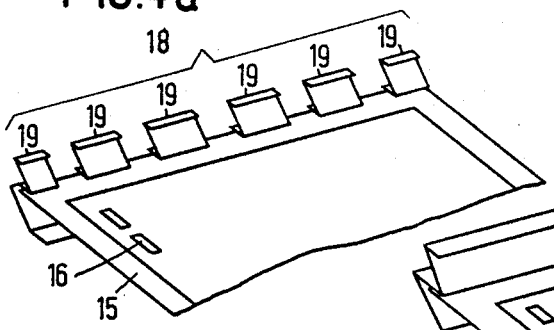
FIGS. 5*a* and 5*b* are perspective views of two embodiments of spring constructions according to the invention which are connected to a color selection electrode.
Figure 5B:
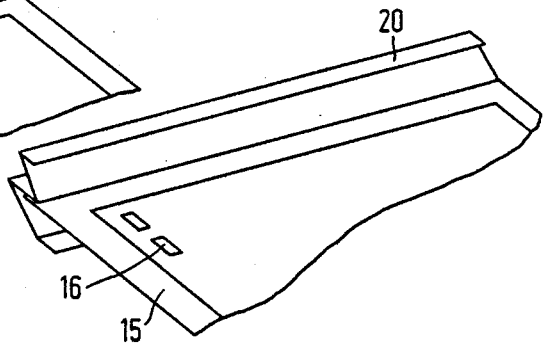

FIGS. 4*a* and 4*b* show two forms of the spring construction 18 in which movements of the apertures 16 in the color selection electrode 15 take place only along the electron paths. Two positions of the spring construction 18 and the color selection electrode 15 are shown in the FIGS. 4. One position is shown as a broken-line spring construction 18 and the other position is shown as a solid-line spring construction 18. Although the spring construction 18 shown in FIGS. 4 comprises a Z-shape, the invention is not restricted to such shapes. However, the spring construction 18 should comprise a substantially flat surface to which a major surface, the upper or lower surface, of the color selection electrode 15 can be connected. Movements of the color slection electrode 15 now take place in such a manner that substantially no undesired bending stresses occur on the color selection electrode 15. In order to fully avoid such bending stresses, the material of which the spring construction 18 consists may be locally weakened. For the FIG. 4*b* spring construction 18, for example, said weakening should be present near the bending line 23 of the spring construction 18. The spring construction 18 may be built up from a number of leaf springs 19 extending over the length of a side of the colour selection electrode 15, as is shown in FIG. 5*a*, or from one long leaf spring 20 which is provided over the length of a side, as is shown in FIG. 5*b*. The individual leaf spring 19 of FIG. 5*a* need not have the same shape. For making corrections towards the corner points of the color selection electrode 15 it is even useful to provide a variation in the shape of the leaf springs 19. The color selection electrode 15 is connected to the spring construction 18 by means of welding or by means of other known methods. During operation of the color display tube temperature variations occur. When the thermal expansion of the spring construction 18 differs from the thermal expansion of the color selection electrode 15, deformations in both the spring construction 18 and the color selection electrode 15 may occur as a result of said differences in expansion. By choosing for the spring construction 18 a material having substantially the same coefficient of thermal expansion as the color selection electrode 15, the possible occurrence of said deformations is prevented.

When the spring construction 18 consists of a number of individual springs, for example as shown in fig. 5*a*, these deformations can also be prevented from occurring by making the width of the individual springs 19 to be sufficiently small irrespective of whether the spring construction has substantially the same coefficient of thermal expansion as the color selection electrode 15. In practice a width of approximately 1 cm proves to suffice. These deformations can also be prevented by providing notches in the edge of the color selection electrode which is connected to the spring contruction. Said notches may also be etched simultaneoulsy, for example, during etching the apertures in the color selection electrode. When a certain color selection electrode 15 is used each spring construction 18, in addition to a smaller spring constant, should also have, for example, a coefficient of thermal expansion substantially equal to that of the color selection electrode 15. When, by way of example, steel having a low carbon content, ($C \leqq 0.004\%$ and Al 0.02–0.06%) is used for the color selection electrode, a spring construction 18 consisting of corrosion-resistant chromium-nickel steel with 16.0–18.0% chromium, 6.50–7.75% nickel and 0.75—1.50% aluminium satisfies the desired requirements.

Figure 6:
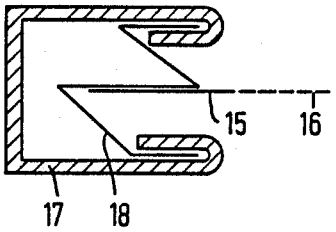
FIG. 6 is a sectional view of one form of frame construction which is connected to a spring construction of the type shown in FIG. 4*a*.
Figure 7:
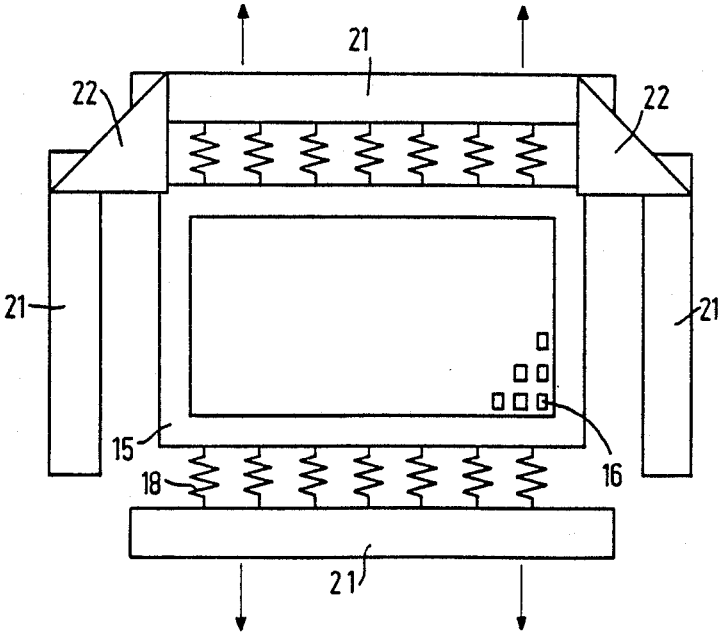
FIG. 7 is a plan view of a color selection electrode connected to a supporting frame consisting of a number of individual beams.

The spring construction 18 is also connected to the supporting frame 17. When said connection is carried out by means of welding or in any other manner in which the spring construction 18 is rigidly connected to the supporting frame 17, deformations may occur in this case also due to the difference in expansion between the supporting frame 17 and the spring 18. By connecting the spring construction 18 to the supporting frame 17 in such a manner that the spring construction 18 and the supporting frame 17 can move relative to each other, said deformations are prevented. FIG. 6 shows an example in which a spring construction 18 is connected in the supporting frame 17 so as to be movable. The edges of the supporting frame 17 are bent over so that slots are formed in which the spring construction 18 can be inserted. The tension of the color selection electrode 15 pulls the edges of the spring construction 18 well into the slots of the supporting frame 17. It is feasible to construct the supporting frame from individual beams 21 as is shown in the plan view of FIG. 7. The spring construction 18 is connected on two oppositely located sides of the color selection electrode 15. A beam 21 is positioned over each spring construction 18. The advantage of a supporting frame constructed from individual beams 21 is that the tension can be produced at the color selection electrode 15 by pulling apart the two oppositely located beams 21 in which the spring constructions 18 are provided. The resulting tensile force should be smaller than the proof stress of the color selection electrode 15 in the direction of drawing so as to prevent permanent deformation of the color selection electrode 15. The individual beams 21 are then connected together at their corners by means of plates 22, as is shown in FIG. 7 for two corners. The individual beams 21 now together constitute the supporting frame 17. The supporting frame may be of metal and be placed at a given distance from the display screen in the evacuated envelope of the color display tube. Alternatively the supporting frame may be substantially of glass, so that, for example, the frame may be constituted by the display screen or the evacuated envelope of the tube. It is also possible, for example, to use as a supporting frame a substantially flat display window which comprises upright edges. The spring constructions which are present at the color selection electrode may then be connected on oppositely located edges of the display window.

Dependent on the form of the color selection electrode, for example a wire grid, a shadow mask having a linear pattern of apertures or a shadow mask having a hexagonal pattern of apertures, a spring construction may be provided on two or on all sides of the color selection electrode. The color selection electrode may then be tensioned not only in one direction as is indicated in FIG. 7 by arrows, but may also be tensioned in a second orthogonal direction, it being ensured that said tensile stress also remains below the elastic proof stress of the color selection electrode in said direction.

What is claimed is:

1. A color display tube comprising in an evacuated envelope: means to generate a number of electron beams; an at least substantially flat display screen having areas luminescing in different colors; and a color selection electrode having apertures for passing the electron beams and for associating each electron beam with luminescent areas of one color, said color selection electrode being tensioned on a supporting frame on at least one set of oppositely located sides of the color selection electrode connected to the supporting frame by means of a spring construction, the spring construction only permitting a maximum tension at the color selection electrode which is smaller than the elastic proof stress of the color selection electrode.

2. A color display tube is claimed in claim 1, characterized in that each spring construction has a spring constant which is smaller than the spring constant of the color slection electrode.

3. A color display tube as claimed in claim 1, characterized in that both sides of each set of oppositely located sides of the color selection electrode which are connected to the supporting frame are connected to said supporting frame by means of a spring construction.

4. A color display tube as claimed in claim 1, characterized in that the spring constructions only permit movements of the apertures in the color selection electrode along the electron paths.

5. A color display tube as claimed in claim 1, characterized in that each spring construction is constructed from a number of juxtaposed leaf springs.

6. A color display tube as claimed in claim 5, characterized in that each spring construction is constructed from one leaf spring extending over the length of the side.

7. A color display tube as claimed in claim 5, characterized in that each leaf spring comprises a substantially flat surface to which a major surface of the color selection electrode is connected.

8. A color display tube as claimed in claim 5, characterized in that each leaf spring has the form of a Z.

9. A color display tube as claimed in claim 1, characterized in that each spring construction has a coefficient of thermal expansion which is substantially equal to the coefficient of thermal expansion of the color selection electrode.

10. A color display tube as claimed in claim 1, characterized in that the supporting frame is composed of a number of individual beams.

* * * * *